US006935622B2

(12) United States Patent
Jonsson et al.

(10) Patent No.: US 6,935,622 B2
(45) Date of Patent: Aug. 30, 2005

(54) LATERAL LOAD BEARING STRUCTURAL CANTILEVERED SYSTEM SUCH AS HIGHWAY GUARDRAIL AND BRIDGE RAIL SYSTEMS

(76) Inventors: Thorgeir Jonsson, Laugarnesvegi 96, Reykjavik (IS), IS-105; David Allen Hubbel, 112 Park Ave., Saranac Lake, NY (US) 12983

( * ) Notice: Subject to any disclaimer, the term of this patent is extended or adjusted under 35 U.S.C. 154(b) by 0 days.

(21) Appl. No.: 10/254,801

(22) Filed: Sep. 26, 2002

(65) Prior Publication Data

US 2003/0077120 A1 Apr. 24, 2003

Related U.S. Application Data

(63) Continuation of application No. PCT/IS01/00005, filed on Feb. 19, 2001.

(51) Int. Cl.[7] ..... E01F 15/00
(52) U.S. Cl. ..... 256/13.1
(58) Field of Search ..... 256/1, 13.1, 19

(56) References Cited

U.S. PATENT DOCUMENTS

| | | | | |
|---|---|---|---|---|
| 518,645 A | | 4/1894 | Crittenden et al. | |
| 523,075 A | | 7/1894 | Krause | |
| 1,759,794 A | | 5/1930 | McDade | |
| 2,007,466 A | | 7/1935 | Campbell | |
| 2,056,858 A | | 10/1936 | Irons et al. | |
| 2,136,415 A | | 11/1938 | Cornett | |
| 2,154,818 A | | 4/1939 | Mayer | |
| 2,160,519 A | | 5/1939 | Robertson | |
| 2,166,097 A | | 7/1939 | Kotrbaty | |
| 2,178,762 A | | 11/1939 | McLaughlin, Jr. | |
| 2,296,419 A | | 9/1942 | Camp | |
| 2,631,014 A | * | 3/1953 | O'Neale | 256/13.1 |
| 2,969,223 A | * | 1/1961 | Hansen | 256/13.1 |
| 3,270,480 A | | 9/1966 | Beecker | |
| 3,328,931 A | | 7/1967 | Smith | |
| 3,410,995 A | | 11/1968 | Gray | |
| 3,467,361 A | | 9/1969 | Moschettini | |
| 3,519,249 A | | 7/1970 | Nave | |
| 3,638,913 A | * | 2/1972 | Persicke | 256/13.1 |
| 3,807,699 A | | 4/1974 | France | |
| 3,981,486 A | | 9/1976 | Baumann | |

(Continued)

FOREIGN PATENT DOCUMENTS

| | | |
|---|---|---|
| DE | 200 16 163 U1 | 12/2000 |
| FR | 2 796 662 | 1/2001 |
| GB | 2 293 402 A | 3/1996 |
| WO | WO 99/05364 | 2/1999 |
| WO | WO 99/61708 | 12/1999 |

*Primary Examiner*—John Cottingham
(74) *Attorney, Agent, or Firm*—Birch, Stewart, Kolasch & Birch, LLP

(57) ABSTRACT

The present invention provides cantilevered structural support systems subjected principally to lateral-load conditions, such as guard rail systems, which are made of solid materials and which are designed to remove drifting snow from the road surface. The present invention identifies the design lateral-load plus vertical design loads imposed via installation activities plus design torsional load requirements plus design required soil-matrix resistance development then matches the structural requirements by way of either material mass and/or shape. The post and block section of the rail are combined into one curved object and divided into two or more branches, connecting the post/block object to the rail. The branch' median curve is above the highest point on the rail's surface. The sectional shape of the rail is elliptical and the axes are declined towards the surface of the road. The present invention can be of homogeneous material such as, but not limited to, wood and/or steel and/or aluminium and/or plastic and/or rubber. The present invention can also be of a composite nature of two or more materials.

26 Claims, 6 Drawing Sheets

U.S. PATENT DOCUMENTS

| | | | |
|---|---|---|---|
| 4,007,917 | A | 2/1977 | Brubaker |
| 4,222,552 | A | 9/1980 | Matteo, Sr. |
| 4,330,106 | A | 5/1982 | Chisholm |
| 4,638,979 | A | 1/1987 | Demarest |
| 4,662,611 | A | 5/1987 | Ruane |
| 4,739,971 | A | 4/1988 | Ruane |
| 4,982,931 | A | 1/1991 | Pomero |
| 5,033,905 | A | 7/1991 | Schmidt et al. |
| 5,069,576 | A | 12/1991 | Pomero |
| 5,152,507 | A | 10/1992 | Lee |
| 5,172,891 | A | 12/1992 | Chen |
| 5,195,727 | A | 3/1993 | Liao et al. |
| 5,219,241 | A | 6/1993 | Picton |
| 5,229,051 | A | 7/1993 | Martin |
| 5,261,647 | A | 11/1993 | Venegas, Jr. et al. |
| 5,275,382 | A | 1/1994 | Charbaut et al. |
| 5,286,137 | A | 2/1994 | Cicinnati et al. |
| 5,336,016 | A | 8/1994 | Baatz |
| 5,402,987 | A | 4/1995 | Duyck et al. |
| 5,429,449 | A | 7/1995 | Baatz |
| 5,462,258 | A | 10/1995 | Gaillard et al. |
| 5,507,473 | A | 4/1996 | Hammer et al. |
| 5,553,437 | A | 9/1996 | Navon |
| 5,657,966 | A | 8/1997 | Cicinnati |
| 5,660,375 | A | 8/1997 | Freeman |
| 5,876,020 | A | 3/1999 | Giavotto |

* cited by examiner

LATERAL LOAD BEARING STRUCTURAL CANTILEVERED SYSTEM SUCH AS HIGHWAY GUARDRAIL AND BRIDGE RAIL SYSTEMS

This application is a Continuation of copending PCT International Application No. PCT/IS01/00005 filed on Feb. 19, 2001, which was published in English and which designated the United States and on which priority is claimed under 35 U.S.C. § 120, the entire contents of which are hereby incorporated by reference.

BACKGROUND OF THE INVENTION

The present Invention generally addresses cantilevered structural supports intended to be subjected to predominately lateral loadings and specifically addresses a new highway guardrail/bridge rail structural system designed for predominately lateral loadings imposed by impacting vehicles or issues such as but not limited to snow-plowing operations. The present Invention offers economic and safety improvements as a new overall structural system over the existing, present art, most frequently encountered standard highway guardrail, i.e. strong-post-W-beam system. Design of structures where lateral forces predominate are encountered in structural systems such as but not limited to sheet-piling and highway guardrail and bridge rail systems. In these cases use of "hot-rolled" steel structural Wide-Flange shapes or "cold-rolled" steel Channel shapes for post members is the normal present art. The normal present art usually uses "cold-rolled" W-beam rail members.

The present Invention addresses problem issues associated with the present state of the art's structural aspects, such as but not limited to:

a) structural design considerations of cantilevered structural support systems, their associated structural sub-systems and/or individual components, such as but not limited to Highway Guardrail Systems, b) fabrication and construction of cantilevered structural support systems, their associated structural sub-systems and/or individual components, such as but not limited to Highway Guardrail Structural Systems, c) failure mode design concerns of cantilevered structural support systems, their associated structural sub-systems and/or individual components, such as but not limited to Highway Guardrail Systems.

The present Invention addresses these concerns while providing for a more efficient use in the amount of material used per individual component and/or structural sub-system and/or overall structural system and/or use of more environmentally friendly materials resulting in either a more economic use of material in the manufacture of guardrail components and/or structural sub-systems and/or lower transportation costs for both raw and finished guardrail components and/or a reduction in the generation of scrap material due to vehicle accidents resulting in lower economic and/or environmental impact of vehicle accidents. The typical highway guardrail structural system consists of three primary components or sub-systems plus connective hardware-fasteners. The three primary components are (i) Post, (ii) Block, and (iii) Rail. The present Invention addresses each of these three primary components individually, addresses the interface and the structural systematic interaction/interdependency between and among the three primary components and addresses the interface and the structural systematic interaction/interdependency between the structural system and the design-intent and the environment of its location. That is, in the case of highway guardrail or bridge rail structural system, the design-intent action of impacting vehicles on the structural system (iv.) and the reaction of the soil-matrix or structural foundation anchoring the guardrail structural system in question (v.). The following expands on the concerns mentioned above, focusing on the typical guardrail post component (i): Post component sub-topics covered are:

a) Structural Considerations Of Post Component, b) Construction Of Cantilevered Structural Support Systems Such As But Not Limited To Highway Guardrail Structural Systems, Focusing On The Post Component, c) Failure Mode Design Concerns On Guardrail Post Component.

a) Structural Considerations Of Post Component The present Invention relates to and addresses concerns inherent to the present art's use of "hot-rolled" steel structural Wide-Flange shapes or "cold-rolled" steel Channel shapes as a highway guardrail post. The following are two such structural considerations required of a Guardrail Post component. First, the most widely used highway guardrail system is the "strong-post" design. Strong-post guardrail systems resist impacting vehicles in a rigid manner providing for little deflection of the cantilevered support post components. The present Invention provides for equal or greater resistance to lateral loads. Second, the present Invention provides for equal or greater "spade" interaction with the standard soil-matrixes compared to the present art. The present art Strong-post guardrail systems depend on in-situ soil matrix strength to carry design-intended loads without structural failure. Expanding on the above issues, laterally loaded shallow foundation piles, such as permanent retaining walls, permanent sea walls, permanent and/or temporary trench walls, underground support structures, and similar structural system components such as guardrail posts tend to be designed as cantilevers. That is, one end of the pile or post is considered structurally "fixed" and the other end is structurally "not-fixed" or "free-to-rotate" or "deflect-under-load"; or the "not-fixed" end is allowed to deflect when under design loadings. In the case of a cantilevered retaining wall component, the design load is usually applied over the length of the pile with higher design loadings at the pile's "fixed" end. The design load usually tapers off as one moves toward the "not-fixed" end of the pile. In the case of a "strong-post" guardrail system, the design load is usually a "point-load" applied via the W-beam rail component thru the "spacer-block" to the "not-fixed" end (in normal guardrail applications the "not fixed" end is the TOP of the post). In any of these case loadings, or similar loadings, the face of the pile or post facing toward the loadings tend to be in "tension" when under design loads. The opposite face of the pile or post tends to be in "compression" when design loads are applied. To maintain structural integrity, the pile or post must transfer "shear" between the opposing faces (tensile/compressive) without significant change in distance between the faces. Failure of the soil matrix to resist the design lateral loadings is usually a result of either inferior soil conditions for the design loads in question, or failure of the post's compressive face to fully develop the strength of the soil matrix due to less than optimal "spade" dimensionality aspects of the post's width of "face" against the in-situ soil matrix in question. (failure of the soil matrix in contact with the post's tensile face should be considered but is usually rare in "short" piles such as guardrail posts as the soil-matrix in question tends to be more structurally strong as one approaches the roadway bedding). Quoting from Reference #1, pages 8 & 9: "Precisely predicting potential ground movements . . . at a specific site and estimating the effects of [ . . . ] the response and any site/structure interaction are conjectures of ethereal proportions. Determining or controlling the conditions of a specific soil mass is a highly approximate exercise. Precisely determining the dimensional changes of complex masses of construction due to thermal or moisture variation is not possible." The post's "top" must retain its structural integrity so as to fully develop the load transfer from the highway guardrail system's "spacer-block".

b) Construction Of Cantilevered Structural Support Systems Such As But Not Limited To Highway Guardrail Structural Systems, Focusing On The Post Component Lateral service loads require a cantilevered structural member such as a highway guardrail post to transfer the service load from its "not-fixed(A)" end to its "fixed(C)" end. In the process, the structural requirements increase as the load moves from "A" to "B". (see FIG. 1). The "strong-post" guardrail system is a cantilevered, moment-resistive frame. Quoting from Reference #1, page 92, "In most cases rigid frames are actually the most flexible of the basic types of lateral resistive systems. This deformation character, together with the required ductility, makes the rigid frame a structure that absorbs energy loading through deformation as well as through its sheer brute strength. The net effect is that the structure actually works less hard in force resistance because its deformation tends to soften the loading. This is somewhat like rolling with a punch instead of bracing oneself to take it head on."

c) Failure Mode Design Concerns On Guardrail Post Component. There are two load cases and two time-sequences, on the subject of failure-mode, that need to be addressed, individually and in combination. (It is assumed that the applied loadings and their nature would be properly investigated to avoid issues such as, but not limited to "shear-punch-thru".) The first load case is "static" loadings. The second load case is "dynamic". The first time-sequence is "constant". The second time-sequence is "intermittent". Most retaining wall loadings are of a "static" nature where the loadings are "constant". That said, retaining walls used near highways and/or in applications such as of bridge-abutments tend to also experience "dynamic" loadings from passing vehicles of an "intermittent" timing nature. In all these cases, when the material is a commonly used structural metal such as steel, it is desirable that the design of the structural member in question be such that when loaded to the point of failure, that said failure not occur in compression and/or shear as these failure modes tend to not give visible ad/or audible notice of approaching structural failure. Tensile failure usually results in elongation on the tensile face or "bowing out" of the structural support system allowing for some visible signs of impending structural failure. In addition, tensile failure of aluminum or steel is usually in conjunction with alerting noise-generation. In the special case of metal guardrail post applications, the desired failure-mode may, in fact, be localized buckling of either the compressive face or the interface region of the compressive face and web. This type of structural failure allows for reduced snagging potential in the event that the impacting vehicle has "laid-back" the line of rail to the extent that the vehicle's wheel would otherwise get "caught" on a post which structurally failed in tension. A catastrophic structural post failure also allows for a transfer of the impacting vehicle's load to be distributed to the up-stream and down-stream posts before the vehicle actually encounters the failed post thereby "softening" the nearby posts' initial load times. Use of wood or wood-like materials for post construction requires other structural considerations. Quoting from Reference #4, page 3–22 "When wood specimens are loaded in bending, the portion of the wood on one side of the neutral axis is stressed in tension parallel to grain, while the other side is stressed in compression parallel to grain . . . " "Bending also produces horizontal shear parallel to grain, and compression perpendicular to grain at the supports. A common failure sequence in simple bending is the formation of minute compression failures followed by the development of macroscopic compression wrinkles. This effectively results in a sectional increase in the compression zone and a section decrease in the tension zone, which is eventually followed by tensile failure." Use of composite wood-steel, or similar configurations, requires identification of failure-mode mechanics to ensure intentional "lay-back" and/or structural failure of the post for proper lateral-resistant structural system response.

While the failure-mode of a typical cantilevered retaining wall is relatively simple, the required failure-mode for the present art standard highway guardrail post is more complex. In the case of a "strong-post" guardrail system, the spacer-block is held in place against the tensile face of the post. The W-beam to spacer-block to post structural connection is by way of the "post-bolt" or "thru-bolt". Highway guardrail posts, due to the "dynamic-design-loadings", carry little in the way of "static" loadings and little in the way of "constant" time-sequenced loadings. Highway guardrail posts are designed for "intermittent" "dynamic" loadings usually applied by way of crashing vehicles. Crashing vehicles transfer loadings to the highway guardrail system's W-beam, which in turn transfers the loadings to the guardrail system's spacer-block, which in turn transfers the loadings to the system's post, which in turn transfers the loadings to the system's post's foundation's soil-matrix. Due to the spacer-block, the spacer-block & post region has significantly greater "section-modulus" than the post alone in the region between the soil-matrix and the start of the spacer-block & post region. Due to the cantilevered nature of the structural configuration, the maximum applied moment to the post component will be at or below the "ground-line" depending on the structural integrity of the soil-matrix foundation in question. That is, in the case of asphalt, the location of the maximum moment loadings will be close to the ground-line. Where the soil-matrix foundation is relatively weak, the location of the maximum moment loading will move below the ground-line. There are four primary "dynamic" service loadings a "strong-post" guardrail post should be designed for. The first primary "dynamic" service loading is the lateral load resulting from impact by a vehicle with the W-beam rail component of the guardrail system. This lateral load is transferred from the rail to the spacer-block then onto the post. The second primary "dynamic" service loading is the torque applied to the guardrail post via the post-bolt. Said torque develops as an impacting vehicle deflects the rail component beyond its original vertical plane. Posts located near the point of impact will be torqued in the direction of the impact. The third "dynamic" service loading is developed when an impacting vehicle strikes with such force as to "lay-back" (or the foundation soil-matrix shears) the guardrail posts. Once the guardrail system has been laid-back, the impacting vehicle's wheel and/or bumper can penetrate under the W-beam and "snag" on the exposed base of the posts. The fourth "dynamic" loading is developed when an impacting vehicle attempts to "climb-over" or "squeeze-under" the rail component resulting in the development of torque as an impacting vehicle deflects the rail component beyond its original horizontal plane. The present Invention addresses these concerns. One means and method for addressing how a post's structural failure can be pre-designed into the structural element's nature is thru the use of placing a "discontinuity" in the material. The discontinuity can be used to provide for a difference in a post element's or block element's, or rail element's structural capacity in tension vs. compression. An application would be where the structural system's designer wished to resist in one direction a lateral load on a post element but wished to have the post provide less resistance from a lateral load applied from a different direction. In a post subjected to a torsion case-load a discontinuity could provide for a post failure in shear across the discontinuity. If the post's discontinuity was located at or near the ground-line then the post could be designed to fail in torsion, breakaway, and remove itself from potentially snagging an impacting vehicle. A discontinuity could provide for both compressive and torsional resistance but subjected to an intended weakness to tensile loads. There are two primary Post System Design concerns: 1. Deflection: Quoting from Reference #3, "No rigid, vertical object shall be placed within the deflection distance from the back of the barrier system." "If dynamic deflection clearance cannot be achieved, the system must be stiffened in front of and upstream from the obstacle. Methods available include decreasing post spacing and double nesting of rail elements. Each stiffening method typically reduces the deflection by a factor of two. The stiffening method should begin 5.4 m (18') in advance of the hazard and continue at least to the end of the hazard." 2. Soil Backing: Quoting from Reference #3, "Strong Post systems—Since there is a considerable contribution to the redirection capability of the system from the strength of the strong posts, it is necessary to develop adequate soil support for the post to prevent it from pushing backwards too easily." Focusing on the "Strong Post, Blocked-out W-beam System's Post component, bearing in mind that this discussion is applicable to the many other predominate lateral-load structural support systems, the Standard W-beam post consists of a "hot-rolled" steel structural Wide-Flange shape or "cold-rolled" steel Channel shape. The post is punched (usually 7" from the post's top) to receive a post-thru-bolt, also known as the "thru-bolt" or "post-bolt" or "block-bolt" or "rail-bolt" or "carriage-bolt". The Post-bolt is the structural connection between and attaching the guardrail system's horizontal rail component, thru the "spacer-block", to the post component. After punching, the "hot-rolled" steel structural Wide-Flange shape or "cold-rolled" steel Channel shape post is usually hot-dipped galvanized. The usual post length is 6 foot, due in part to concerns about installation site soil-matrix conditions. The usual post spacing along the horizontal rail component, center-to-center, is 6'-3". The typical steel grade requirement is 36 ksi.

Block component sub-topics covered are:

a) Structural Considerations Of Block Component:

b) Construction of Cantilevered Structural Support Systems Such As But Not Limited To Highway Guardrail Structural Systems, Focusing On The Block Component:

c) Failure Mode Design Concerns On Guardrail Block Component.

a) Structural Considerations Of Block Component:

The present Invention's spacer-block is an application of the "flying buttress" concept taken from 14th and 15th century medieval church design. That is, an arch . . . abutting against the wall of a vault ceiling; the thrust of the vault can thus be received and transferred to the vertical buttress, i.e. Post & Block. The present Invention's block, an integral structural extension of the post, which concentrates the great lateral thrusts of impacting vehicles of the highway guardrail W-beam component and via moment-resistance which begins the structural process of transferring the lateral loadings to the foundation soil-matrix by way of the Post component. There are four (4) important attributes of the present Invention's spacer-block post design. First, there is an overall reduction in the required guardrail post length by recognition that the section-modulus requirements can be carried by the block itself, as the structural requirements are significantly less than at ground-line. Second, the present Invention's block design, when two or more branch configurations are used, reduces the "FREE-SPAN" distance on the RAIL component, compared to the standard W-beam guardrail component, or the present Invention's rail component. This significant reduction in unsupported-length allows for reductions in the dimensionality of the present Invention's rail component such as, but not limited to thickness and/or depth and/or other attributes such as strength-of-materials issues. Third, the present Invention's block is "masked" from impacting vehicles by the W-beam rail component. That is, unlike the present standard spacer-block which is required to extend an inch above and below the W-beam rail component, (the standard W-beam rail component having a projected 12" face and the standard block being 14") the present Invention's block reduces the potential for "snag". Studies of crash-tests clearly show impacting vehicle body components extending above and/or below the present art W-beam rail as the vehicle "rides-the-rail". Said same vehicle body components encounter and "snag" on the standard spacer-block portions that extend, in the vertical plane, beyond the W-beam. Fourth, the present Invention's block design acts as a "backing-plate" for the rail component.

b) Construction of Cantilevered Structural Support Systems Such As But Not Limited To Highway Guardrail Structural Systems, Focusing On The Block Component: Lateral service loads require a normally compressive structural member such as a highway guardrail block to transfer the service load from its face that is attached to the rail element to its face attached to the post element. However, as the impacting vehicle begins to interact with the rail element, after initial impact, the block reacts as a beam. That is, as the rail element is displaced from its original position, by the impacting vehicle, either in the vertical plane and/or in the horizontal plane, the post-bolt "pins" the center of the block and is placed in tension and/or shear. Assuming the block retains structural integrity, a moment-couple will develop between the post-bolt and an edge or edges of the block. The present art, because only half of the block can be structurally loaded due to the center-position of the post-bolt, does not allow the full development, thru composite action, of the structural strength of the block. The present Invention uses a structural post block configuration where one end is considered structurally fixed or not able to rotate or classified as a moment-resistant connection and could be classified as a post, and the other post end is found off center or rotated away from the projected line of the structurally fixed end, or post end and is attached to the rail element. The present Invention can also be a structural assembly wherein the post's end not structurally fixed comprises of the ends of two or more branches, said branches arching in both the vertical and horizontal planes relative to the post's foundation. The present Invention can also be a structural assembly in wherein the post's end not structurally fixed comprises of the ends of two or more branches, where said branches have different cross-sectional areas along the length of individual branches. The present Invention can also be a structural assembly wherein the post's end not structurally fixed comprises of the ends of two or more branches, where said branches have different cross-sectional shapes along the length of individual branches. The present Invention can also be a structural assembly in wherein the post's end not structurally fixed comprises of the ends of two or more branches, where said branches have different section modulus along the length of individual branches. All these configurations allow full composite structural development between the "block" portion of the present Invention's post block element and the "post" portion.

c) Failure Mode Design Concerns On Guardrail Block Component.

The present art primary failure mode design concern is that the block should keep and maintain the design distance between the post component and the rail component for the design loads intended. When loadings in excess of design loads are encountered, the block should structurally fail only after a structural failure of the post. A block should structurally maintain its physical location between the post component and the rail component so as to continue its mission as a "spaces" and maintain its shape. This is frequently not the case where wood spacer blocks are used. That is, when standard, presently acceptable wood-spacer-blocks are used and subjected to loadings in excess of anticipated design loads, the wood block shears and/or breaks into smaller pieces and are usually ejected from the highway guardrail's structural system. Once the wood block is eliminated, the rail component is no longer held away from the post component and the impacting vehicle tends to "snag" on both the thru-bolt and the post component. That said, in cases of significant lateral loadings greater than design loads, a block should structurally fail once its companion post element has deformed and/or displaced and has assumed a position bent back and in the proximity of the ground-line. That is, to avoid having the block become the cause of vehicle snagging, once the structural failure of the post element is substantially complete, the block element should be designed to structurally fail such that it separate from the rail element and/or the post element. It is desirable that in addition to the aforementioned structural separation that the block easily deform if, after post failure, the block comes in contact with an impacting vehicle. If block separation does not occur easily the vertical aspect or height of the rail element may be reduced resulting in a greater probably of the impacting vehicle rolling over the rail. A secondary failure mode design concern is that the block should provide torsion-resistance by structurally transferring loads to the next post component in line. That is, an impacting vehicle tends to "pocket" the structural system of a line of highway guardrail. This pocketing draws the rail component toward the impacting vehicle. The rail component in turn pulls the spacer-block with it which results in the spacer-block applying torsion to the post component. If the block is sufficiently stiff and maintains good structural integrity with both the rail and post components then the block's rotation will develop additional tension in the next rail component and thereby transfer loads to the next post in the line. This results in the favorable condition of keeping the "pocket" shallower" than otherwise. Another secondary failure mode design concern is that the block should provide help in keeping the rail component splice region in-plane. That is, when an impacting vehicle creates a large pocket in a line of guardrail and said pocket's leading-edge, as the impacting vehicle "plows" along the line of guardrail, encounters a splice where one rail component is attached to the next rail component, there is a tendency for the rail to bend just in front of, at, or just after the last line of splice bolts. The bending occurs in this region of the rail structural sub-system of the guardrail's overall structural system because the rail components are over-lapped and in the over-lap splice region the rail is significantly stiffer than just after the line of splice bolts farthest from the impacting vehicle on the leading edge of the pocket. The present Invention provides additional stiffness to the rail beyond this last line of splice-bolts.

The following expands on the concerns mentioned above, focusing on the typical guardrail Rail component:

Rail component sub-topics covered are:

a) Structural Considerations Of Rail Component, b) Construction of Cantilevered Structural Support Systems Such As But Not Limited To Highway Guardrail Structural Systems, Focusing On The Rail Component, c) Failure Mode Design Concerns On Guardrail Rail Component.

a) Structural Considerations Of Rail Component:

The present art "strong-post" highway guardrail lateral structural support system, also known as strong post W-beam, is engineered to resist deflection primarily via the post and block components. While the W-beam rail component can act to "bridge" loads to the nearby post/block structural sub-system by way of "beam-action", the standard, present art W-beam, when loaded to design capacity, quickly deflects and goes into a tension-state much like a span-wire or cable. The W-beam rail component was "institutionalized" by United States State and Federal Transportation agencies in 1956–1957. In addition to the other concerns addressed, the evolved construction and design concepts of present day vehicles vis-a-vis the pre-1956 passenger-vehicles has not been reflected in the standard Strong-Post guardrail systems. Pre-1956 passenger vehicles tended to be "hard-shelled". That is, they were designed, in general, to be rigid boxes with wheels. As such, relatively less stiff crash barriers were designed so as to absorb impacts. The patents for crash barriers pre-1990, in general, discuss providing shock-absorbing barrier. At issue is the use of the W-beam rail. Present day passenger vehicles tend to reflect the design concept that the passenger compartment be rigid with the rest of the vehicle sacrificial, that is, crashable and impact shock-absorbing. Unfortunately, the present day passenger vehicle with the collapsible, shock absorbing front fenders and bumpers, when impacting a standard W-beam, can act to "ramp" the vehicle either up-and-over or down-and-under the W-beam rail until the rigid-structural-components of the passenger compartment engages the rail component. This condition potentially results in pieces of the vehicle's fender and/or bumper protruding past the vertical plane of the W-beam rail and snagging on the standard block portions that extend above and below the W-beam rail unit and/or snagging on the post unit even in low impacts where the guardrail is still upright (not laid-back as a result of a high-energy impact or weak soil foundation conditions). Other standard guardrail systems make good use of the present day passenger vehicle's crush-zones such as the box-beam (6" face) or the cable rail systems where the rail component becomes "imbedded" in the vehicle's crush-able components, develop a "crease" in the forward quarter of the vehicle and as such deny the vehicle significant movement in the vertical plane. On impact with a vehicle, the W-beam, at the point of impact, "hinges". The W-beam sections up-stream from the impact point are put into tension. The W-beam sections downstream from the impact point are, initially, loaded axially. As the impacting vehicle deflects or pushes the guardrail system back from its original line (vertical plane), the W-beam sections nearby are also put into some bending. The structural behavior of the individual W-beam section is influenced by the structural connection joint between the W-beam and the spacer-block component. There are two dissimilar structural joint connections in the present art W-beam strong-post guardrail system. The first structural joint is a moment-resistant lap-splice joint where two individual W-beam sections are connected. This overlapping adds significant stiffness to this location. The structural connection to the spacer-block and post components is made by way of a carriage-bolt or post-bolt which passes thru the lap-splice then thru the spacer-block and finally thru the traffic-side flange of the steel wide-flange post where the bolt is fixed with a nut and washer. In the case of a wood post, the bolt passes completely thru the post and is fixed with a nut and washer on the away-from-traffic side of the post. The second structural joint is a pin-connection-type at spacer-block-&-post locations between rail splice locations. The standard, present art, W-beam Rail component is pierced with an eight individual splice bolt hole pattern at the lap-splice. The W-beam rail is also pierced in the valley between the corrugations to accommodate the post-bolt. The cross-sectional area reduction of the W-beam by the splice-bolt hole pattern makes this location the structural weak-point in the rail component structural sub-system of the guardrail system. Shear-tear failure frequently occurs in this region of the W-beam. Failure usually occurs when an impacting vehicle deflects the guardrail line resulting in application of torque to the nearby posts, thru the post-bolt connection. As the posts rotate toward the point of largest deflection off the original line, of the moving "pocket" created by the impacting vehicle as it "rides" the line of rail, the down-stream W-beam lap splice's farther line of splice-bolts are put into "prying-action". The present Invention's block is designed to mitigate this prying-action source of potential structural failure. At those intermediate locations where the W-beam is attached to a block and post not at a lap-splice, the post-bolt is the only fastener present. The connection is significantly less moment-resistant as the block's width and post-bolt is the only resistance to the rail rotating around the connection. The present Invention's block's additional width provides greater rotational resistance.

b) Construction of Cantilevered Structural Support Systems Such As But Not Limited To Highway Guardrail Structural Systems, Focusing On The Rail Component: The lateral loadings required to be carried by a guardrail's rail component is dictated, in large part, by the "free-span" the rail component is required to bridge between support points provided by the post/block configuration. Present art guardrail systems are usually configured with a post spacing of 6 ft for box beam and 6 ft-3 in for the strong-post, W-beam system. There is a direct relationship between the post-spacing and the amount of defection that the guardrail system will experience for a specific lateral loading, if the rail component remains structurally intact. The rail component's cross-sectional shape directly affects the flow of air mass passing by the guardrail system. Tests have shown that the present art's use of the W-beam is not aerodynamic and is a leading cause of airborne solids accumulation on roadway surfaces such as snow or sand. The present Invention provides for an aerodynamic shape to the rail component which minimizes accumulation on roadway surfaces of airborne solids. Positioned properly, the present Invention's rail element can accelerate fluid-flow, such as air-mass, over the nearby surfaces thereby encouraging sublimation-of-ice, dissipation-of-previously-deposited-solids such as snow, and evaporation-of-standing-liquids such as water of driving surfaces. When wood is used as the rail element's primary material, the present Invention benefits, in specific environments such as but not limited to rain conditions, from a potential reduction in Coefficients of sliding friction. (see Reference #4, page 3–13) Quoting from Reference #4, "The sliding coefficient of friction for wood is normally less than the static coefficient and depends on the speed of sliding." "Sliding coefficients vary slightly with speed when the moisture content is less than 20 percent. At higher moisture contents, sliding coefficients decrease substantially as speed increases. Coefficients of sliding friction for smooth, dry wood against a hard smooth surface average from 0.3 to 0.5." From Reference #4, page 102, Table 2.4 "Coefficients of Static and Sliding Friction"

Teflon on Teflon static: 0.04

Hard steel on hard steel static: 0.78 sliding: 0.42

Mild steel on mild steel static: 0.74 sliding: 0.57

Aluminum on mild steel static: 0.61 sliding: 0.47

Aluminum on aluminum static: 1.05 sliding: 1.40

As shown above, a rail made of wood will provide a "slicker" surface for an impacting vehicle which may lead to a lower deceleration rate resulting in a safer crash event for vehicle occupants.

c) Failure Mode Design Concerns On Guardrail Rail Component. Failure mode concerns, of the present art, of the guardrail rail component are:

tearing originating in the splice-bolt-hole pattern, tearing originating on the top and/or bottom edge, collapse of the corrugations at the point of impact, rotation at post locations.

"pull-down" from post deflection.

The following expands on the concerns mentioned above, focusing on the action of the design-intent of impacting vehicles on the structural system (iv): Present day passenger vehicles tend to reflect the design concept that the passenger compartment be rigid with the rest of the vehicle sacrificial, that is, crash-able and impact shock-absorbing. Unfortunately, the present day passenger vehicle with the collapsible, shock absorbing front fenders and bumpers, when impacting a standard W-beam, can act to "ramp" the vehicle either up-and-over or down-and-under the W-beam rail until the rigid-structural-components of the passenger compartment engages the rail component. This condition potentially results in pieces of the vehicle's fender and/or bumper protruding past the vertical plane of the W-beam rail and snagging on the standard block portions that extend above and below the W-beam rail unit and/or snagging on the post unit even in low impacts where the guardrail is still upright (not laid-back as a result of a high-energy impact or weak soil foundation conditions). Other standard guardrail systems make good use of the present day passenger vehicle's crush-zones such as the box-beam (6" face) or the cable rail systems where the rail component becomes "imbedded" in the vehicle's crush-able components, develop a "crease" in the forward quarter of the vehicle and as such deny the vehicle significant movement in the vertical plane. The present Invention's aerodynamic shape enhances the rail's ability to develop a crease in an impacting vehicle's crash-zone thereby holding the vehicle and not allowing the vehicle to ramp over or under the rail element. The present Invention's post/block structural unit configuration provides a number of improvements on the present art's design-intent action of impacting vehicles on the structural system. One of the present Invention's improvements is that its post/block unit allows for an energy absorbing response to lateral service loads by virtue of the arch or bow shape of the post/block as it converts from a vertical-like origination at ground-line to a horizontal-like origination at its connections to the rail element. The following expands on the concerns mentioned above, focusing on the reaction of the soil-matrix or structural foundation anchoring the guardrail structural system in question (v.):

The structural adequacy of a Strong-Post guardrail rests on the interface between the post component, and the post's foundation. One of the systemic test results hi-lighting the importance of the post/foundation interface is that crash-tests using standard steel posts and crash-tests using wood posts have very similar vehicle outcomes. The only component difference in the testing is that the wood post has an ultimate strength in the range of 8,000 lbs to 14,000 lbs (these values are based on assumed point-loads and assumed heights above ground-lines) Similar testing on steel posts show ultimate strength ranges of 19,000 lbs to 22,000 lbs. The significant structural difference accounting for the systems similar load carrying abilities is in the post-to-foundation interface. The stronger steel post presents a 4" face to the in-situ soil vs the 6" face of the wood post. That is, the initial impact loadings are transferred to the soil with more bearing surface by way of the wood post. (the wood post also fails catastrophically) The present Invention recognizes the material economy of a post that offers the in-situ soil a broader, more spade-width, face and therefore allowing for a shorter overall post length. That is, providing a fabricated steel post with a wood-post-like 6" face on the compressive flange allows for either more load-bearing before soil foundation shear-failure or more material in the critical compression localized-buckling region of the post (thereby providing for more load capacity) or both.

SUMMARY OF THE INVENTION

It is therefore an object of this invention to provide an architecturally pleasing post component for cantilevered structural support systems subjected principally to lateral-load conditions, such as guard rail systems, which is more economic to fabricate while addressing the structural and safety design concerns mentioned above. It is therefore another object of this invention to provide an architecturally pleasing rail component for cantilevered structural support systems subjected principally to lateral-load conditions, such as guard rail systems, which is more economic to fabricate while addressing the structural and safety design concerns mentioned above. It is therefore still another object of this invention to provide an architecturally pleasing cantilevered structural support systems subjected principally to lateral-load conditions, such as guard rail systems, which is more economic to fabricate while addressing the structural and safety design concerns mentioned above. It is further an object of this invention to provide an architecturally pleasing post component for cantilevered structural support systems subjected principally to lateral-load conditions, such as guard rail systems, which is more environmentally-friendly to fabricate while addressing the structural and safety design concerns mentioned above. It is an additional object of this invention to provide an architecturally pleasing rail component for cantilevered structural support systems subjected principally to lateral-load conditions, such as guard rail systems, which is more environmentally-friendly to fabricate while addressing the structural and safety design concerns mentioned above.

It is therefore another object of this invention to provide an architecturally pleasing cantilevered structural support systems subjected principally to lateral-load conditions, such as guard rail systems, which is more environmentally-friendly to fabricate while addressing the structural and safety design concerns mentioned above. It is further an object of this invention to provide an architecturally pleasing post component for cantilevered structural support systems subjected principally to lateral-load conditions, such as guard rail systems, which is more environmentally-friendly to maintain while addressing the structural and safety design concerns mentioned above. It is an additional object of this invention to provide an architecturally pleasing rail component for cantilevered structural support systems subjected principally to lateral-load conditions, such as guard rail systems, which is more environmentally-friendly to maintain while addressing the structural and safety design concerns mentioned above.

It is therefore another object of this invention to provide an architecturally pleasing cantilevered structural support systems subjected principally to lateral-load conditions, such as guard rail systems, which is more environmentally-friendly to maintain while addressing the structural and safety design concerns mentioned above. It is still another object of this invention to provide an architecturally pleasing combination of the present art post function and present art block function in a single component.

Further it is still another object of this invention to provide an architecturally pleasing combination of the present art post function and present art block function in a single component that provides a more elastic response to lateral loadings allowing for a more uniform system-wide loading of the cantilevered structural support systems.

It is an additional object of this invention to reduce the generation of scrap material due to vehicle accidents resulting in lower economic and/or environmental impact of vehicle accidents.

These and other objects, advantages and features of the present invention will be more fully understood and appreciated by reference to the written specification and appended drawings.

Utilizing Beecker's teaching that "in order to utilize all the material in a pole to its full value, it is necessary to design a pole so that the sectional moduli throughout the pole length increases in the same proportion as the bending moment", the present invention identifies the design lateral-load plus vertical design loads imposed via installation activities plus design torsional load requirements plus design required soil-matrix resistance development then matches the structural requirements by way of either material mass and/or shape. This is in opposition to the present art of accepting material inefficiency due to the present use of standard wide-flange steel beams of constant cross-sectional, and therefore constant sectional moduli structural properties. The present invention can be of homogenous material such as, but not limited to, wood and/or steel and/or aluminium and/or plastic and/or rubber. The present invention can also be of a composite nature of two or more materials.

Use of the present Invention results in either a more economic use of post material and/or block material and/or rail material in the manufacture of guardrail components and/or lower transportation costs for both raw and finished guardrail components and/or a reduction in the generation of scrap material due to vehicle accidents resulting in lower economic and/or environmental impact of vehicle accidents.

The present invention's block component is an application of the "flying buttress" concept taken from 14th and 15th century medieval church design. That is, an arch . . . abutting against the wall of a vault ceiling; the thrust of the vault can thus be received and transferred to the vertical buttress, i.e. Post & Block. The present invention's block concentrates the great lateral thrusts of impacting vehicles on the highway guardrail beam component and begins the structural process of transferring the lateral loadings to the foundation soil-matrix by way of the Post component.

The present invention's rail component addresses present passenger vehicle design resulting in greater safety.

BRIEF DESCRIPTION OF THE DRAWINGS

FIG. 2 is limited to "below ground-line" aspects. That is, "above ground-line" issues are not addressed in this FIG. 2. The chosen load conditions assume a lateral loading on the post with a rotation-point below the ground-line. That is, the post is "pinned" at a distance below the ground-line. In the case of a highway guardrail post, this condition is encountered when a post is "placed" into a soil-matrix that is weaker in shear than the post is structurally strong, i.e. the soil-matrix fails before the post fails structurally.

FIG. 3 is limited to "below ground-line" aspects. That is, "above ground-line" issues are not addressed in this FIG. 3. The chosen load conditions assume a lateral loading on the post with a rotation-point at ground-line. That is, the post is "pinned" at the ground-line. In the case of a highway guardrail post, this condition is encountered when a post is placed in asphalt, i.e. the post fails before the soil-matrix shears.

DETAILED DESCRIPTION OF THE PREFERRED EMBODIMENT

Figure 1:
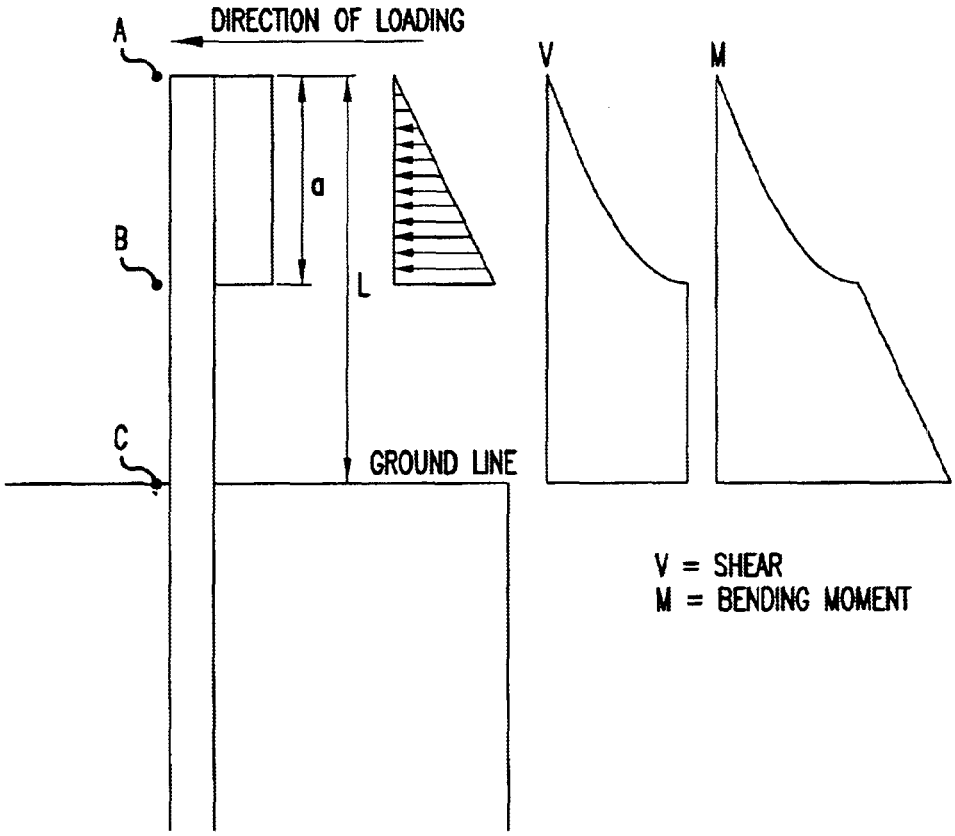
FIG. 1 presents the predominate case loadings for laterally-loaded structural support systems such as but not limited to highway guard rail systems. The attached discussion is limited to "above ground-line" aspects. That is, "below ground-line" issues are not addressed in this Figure. The chosen load conditions assume a lateral loading highest at point B and tapering off to zero at point A. This is a load condition similar to that of a uniform load initially applied across the face A-B, followed by a displacement of the cantilevered column resulting in a load shift from A toward B. A specific example would be an impacting vehicle hitting hard enough to "lay-back" the post in question.
Figure 2:
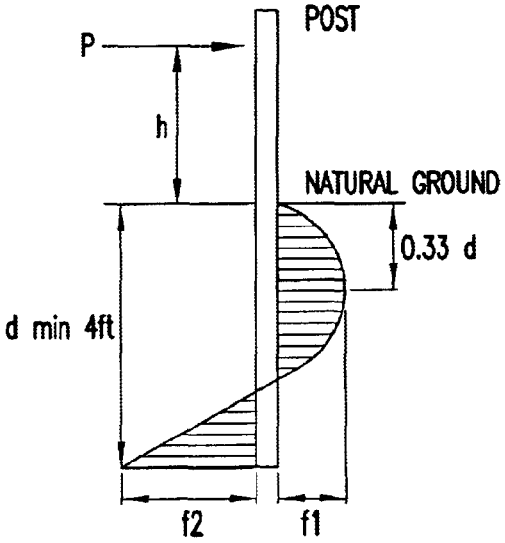
FIG. 2 presents one of two predominate case loadings for laterally-loaded structural support systems such as but not limited to highway guard rail systems.
Figure 3:
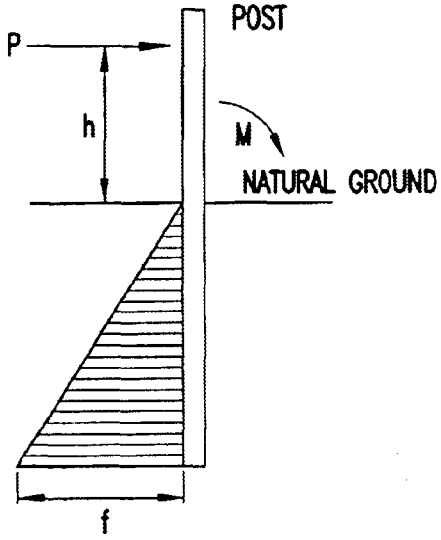
FIG. 3 presents one of two predominate case loadings for laterally-loaded structural support systems such as but not limited to highway guard rail systems.
Figure 4:
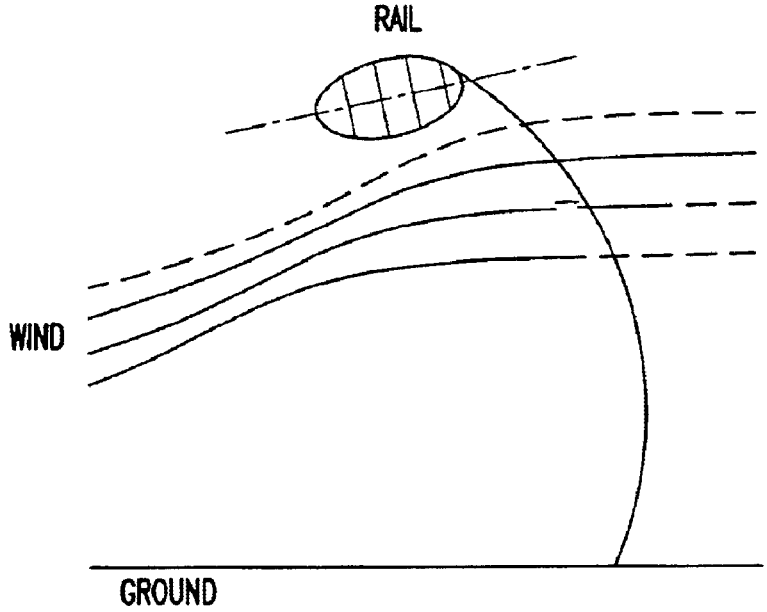
FIG. 4 is a section view of the rail element and how it redirects the flow of wind
Figure 5:
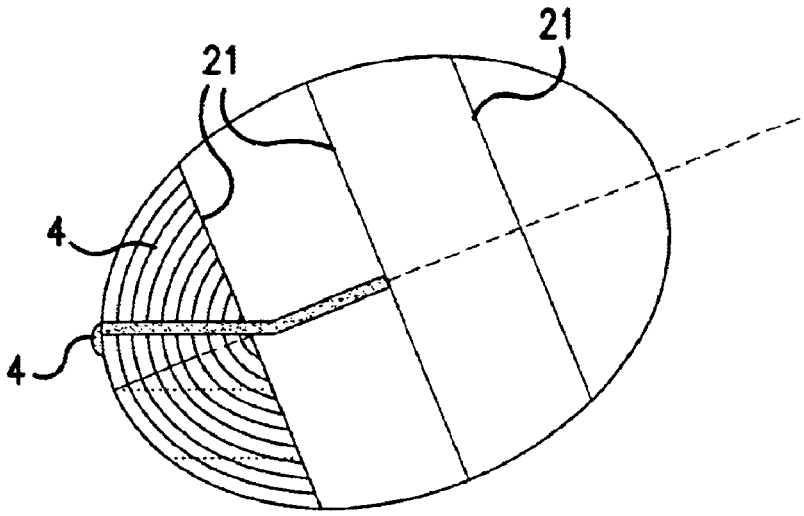
FIG. 5 is a section view of the rail element and placement of inserts in the contact zone of the rail
Figure 6A:
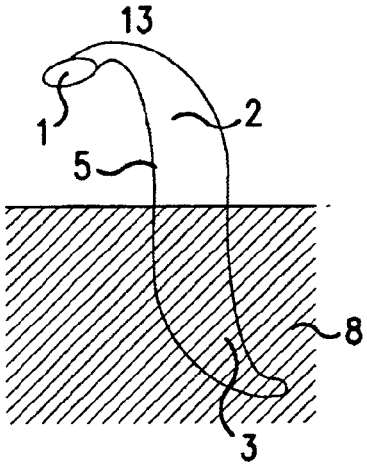
FIG. 6 is a section, plan and elevation view of the assembly of the present invention. Here it is shown with two and three-fingered solution.
Figure 6B:
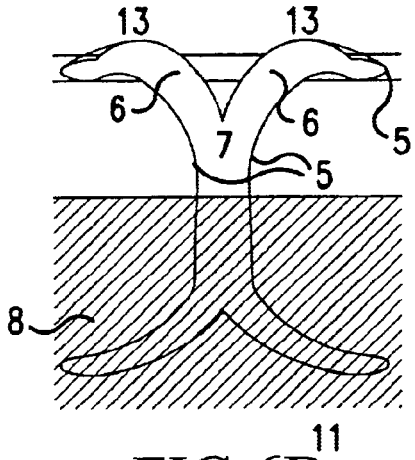
Figure 6C:
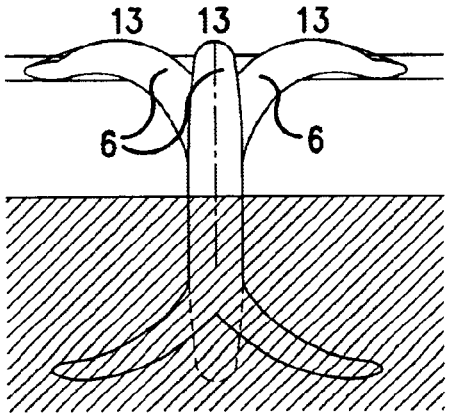
Figure 6D:
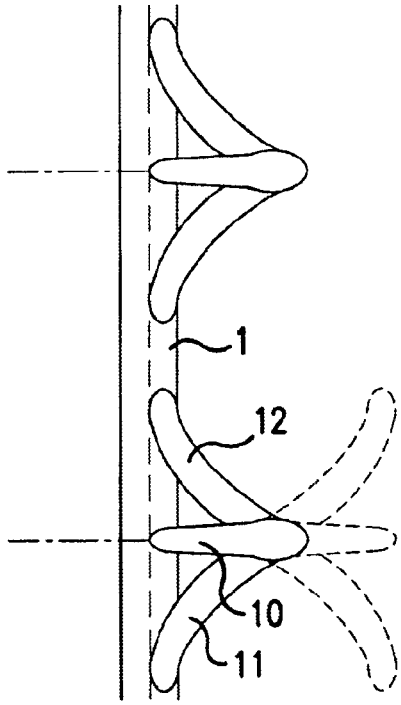
Figure 6E:
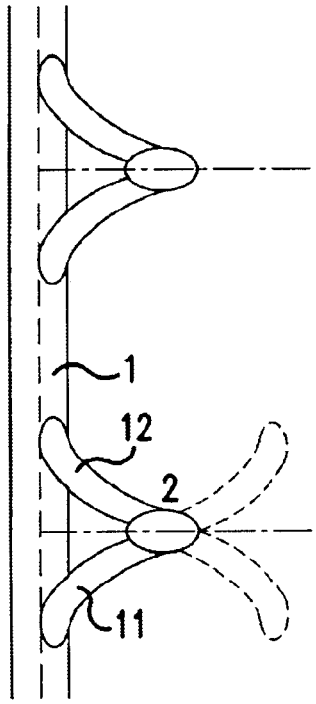
Figure 7A:
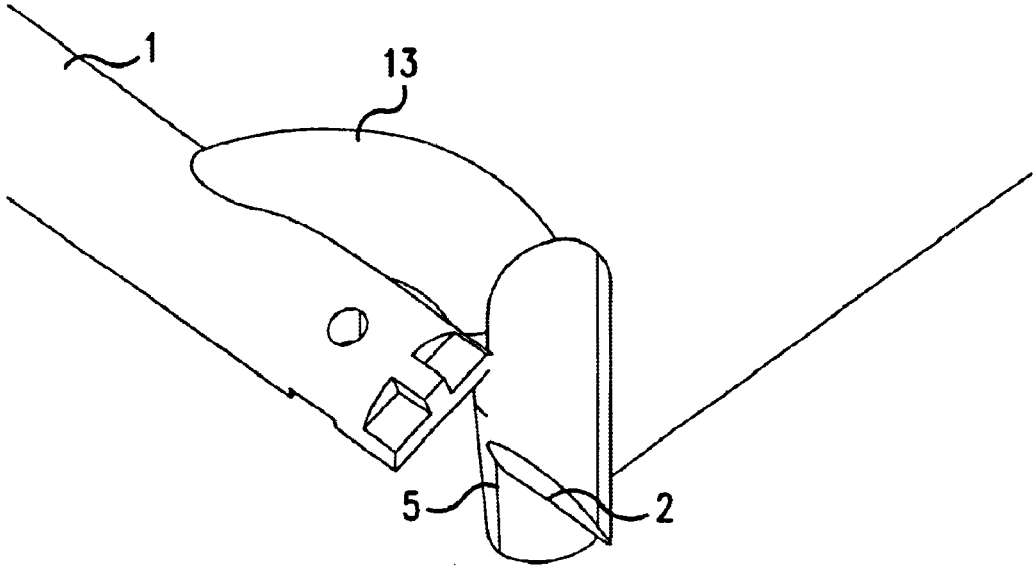
FIG. 7 is an isometric view of the post/rail connection.
Figure 7B:
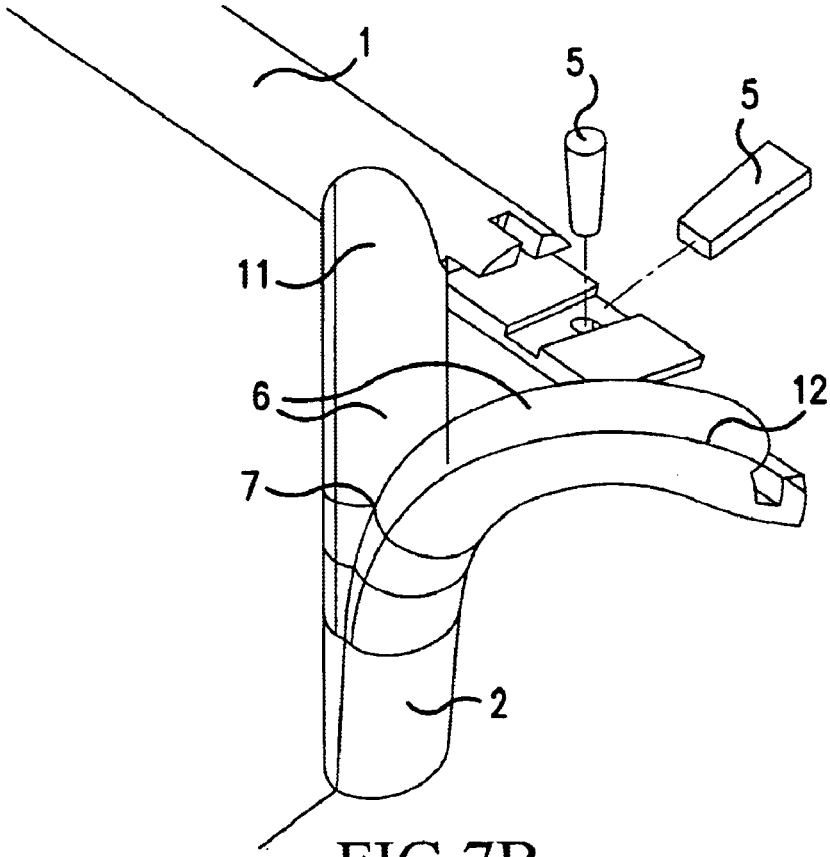
Figure 8:
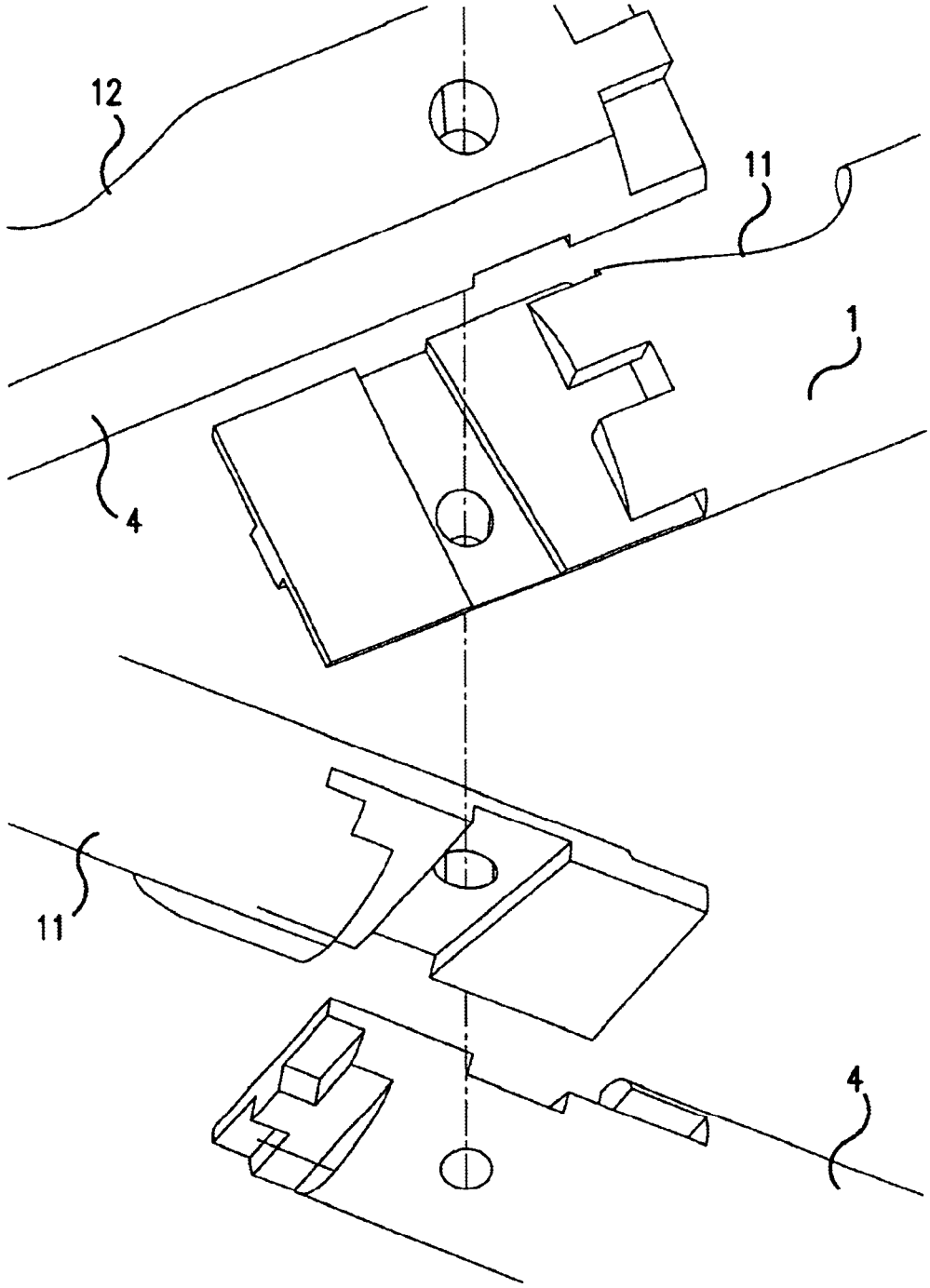
FIG. 8 is an over/under isometric view of the rail connection.
Figure 9A:
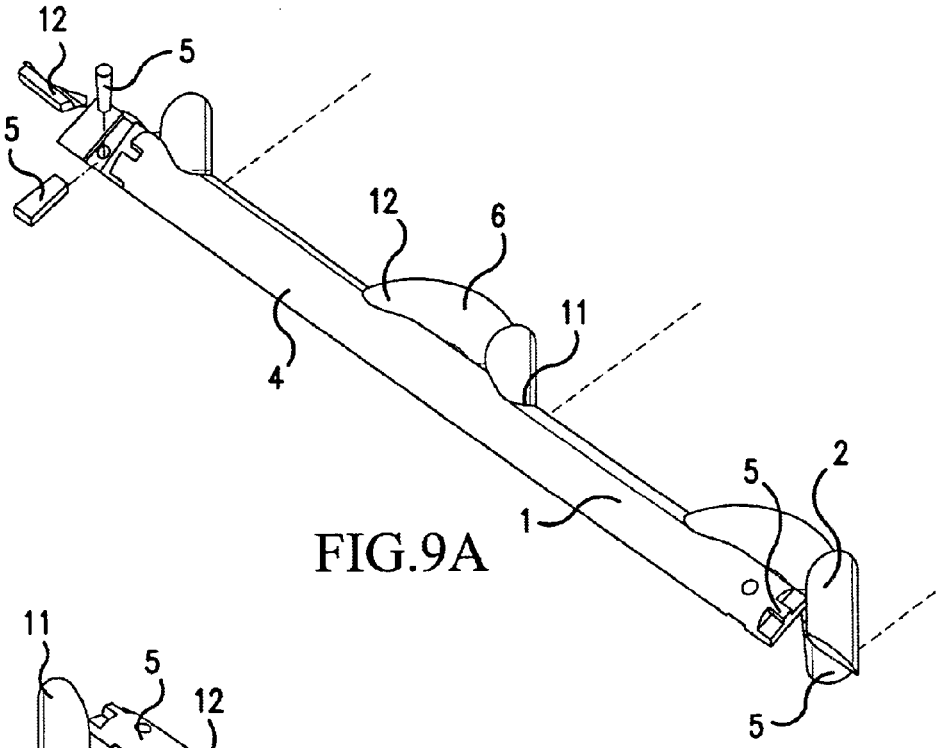
FIG. 9 is an isometric view of present invention, front view and back view.
Figure 9B:
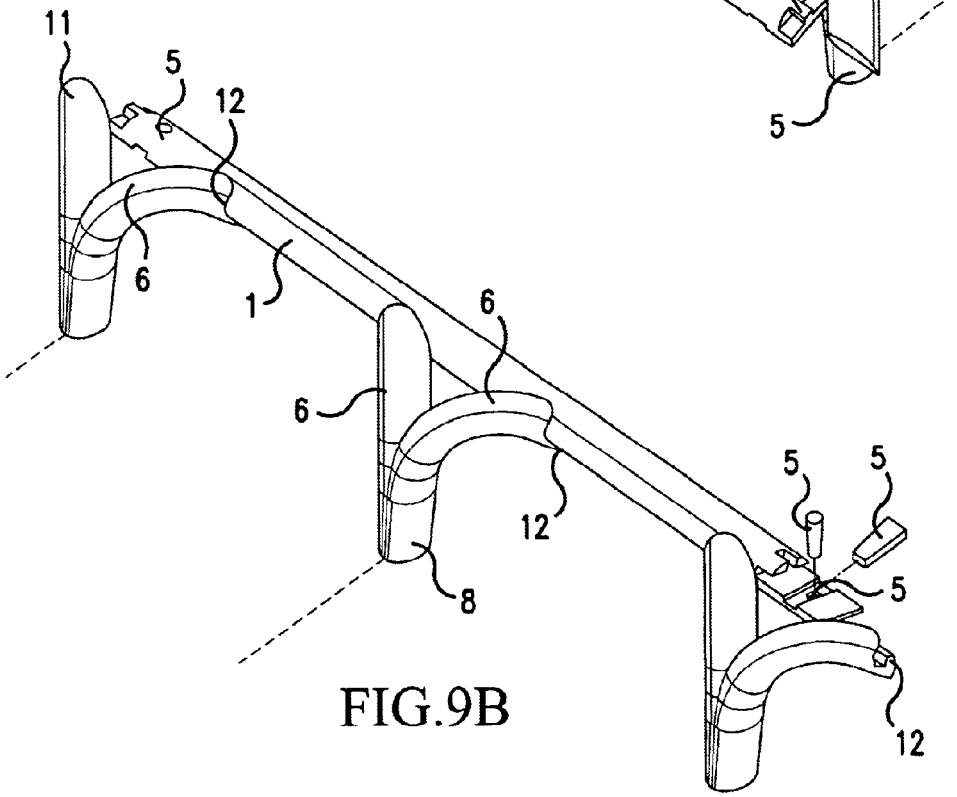

The present Invention's preferred embodiment is an all wood, aerodynamically shaped, designed for lateral loads, structural system for use as a highway crash barrier. The structural system consists of a structural rail (1)element, originated generally in the horizontal, and a structural sub-system consisting of structural post (2)elements attached to the aforementioned rail (1) element at one end and at the other end embedded in a soil-matrix foundation (3) or secured by other means to another structural member such as but not limited to bridge deck or bridge fascia. The rail (1) and/or post(2) elements are shaped to address aerodynamic functions such as but not limited to increasing or decreasing wind velocities and/or wind direction. The aerodynamic function provides a means and method of encouraging or discouraging accumulation of fluid-born solids such as but not limited to wind-blown snow. The aerodynamic function also provides a means and method for direction and/or acceleration or deceleration of fluid-flow. Examples of fluid-flow direction and/or acceleration design application is the use of a generally transverse wind redirected and/or accelerated by the rail and/or post elements' aerodynamic design (see FIG. 4) to scour snow from road and/or bridge surfaces and/or building roofs. Positioned properly (see FIG. 5), the present Invention's rail (1) element can accelerate fluid-flow, such as air-mass, over the nearby surfaces thereby encouraging sublimation-of-ice, dissipation-of-previously-deposited-solids such as snow, and evaporation-of-standing-liquids such as water of driving surfaces. The rail(1) element is preferably a laminated (21)wood beam, either built-up into the desired aerodynamic shape or machined into the desired aerodynamic shape after lamination. Unlike existing laminated rail systems, the present Invention's origination of the laminates (21) provides for maximum lateral load carrying capacities. Where the present Invention is expected to be subjected to lateral loads such as snow plowing, the rail element may include specific hardwood and/or metal inserts (4) at the anticipated potential interface between the rail element and snow plow blade. The rail and post elements may also include specific hardwood and/or metal inserts (5) at the anticipated potential interface between the rail(1) and post(2) elements and solids such as ice and stones expected to be carried by plowed snow mass and pushed past the present Invention. The post(2) elements consist of three separate laminated wood components(6). The three post components(6) are attached to each other at near the ground-line(7) and extend down together into the soil-matrix(8). Above-the-ground-line the laminated wood is bent, toward the rail element(1), in a three-fingered configuration(6). The center bent (10) is 90 degrees to the rail component(1), with the left (11) and right (12)bents reaching toward the rail element in the vertical plane and away from the center-bent in the horizontal plane. The three bents act in the nature of archery bows. That is, the bents absorb the energy of a vehicle impacting the rail element while yielding. In the process of yielding or bending by the posts(2) nearest the initial loading(s), the load imposed on the rail element(1) is transferred to the adjacent posts(2) upstream and downstream of the impact point. The present Invention's post/block(13) structural unit configuration provides a number of improvements on the present art's design-intent action of impacting vehicles on the structural system. First, the present Invention's post/block (13)unit allows for an energy-absorbing response to lateral service loads by virtue of the arch or bow shape of the post/block(13) as it converts from a vertical-like origination at ground-line to a horizontal-like origination at its connections(7) to the rail element(1). Second, the present Invention's preferred embodiment, of its post/block unit(10,11,12), has its arch or bow crest above (13) to rail element. As such, as an impacting vehicle displaces the rail element(1), the post/block unit (13) displaces back-and-upward. This back-and-upward rotation of the post/block (13)unit tends to raise to rail element. As the rail element (1)has penetrated the vehicle's crush-able body zone, raising the rail element(1) holds the vehicle in a more stable position and encourages the vehicle to redirect. Third, the present Invention's preferred embodiment, of its post/block unit(13), leans toward traffic from the ground-line. this means that in cases of lateral loadings in excess of design service loads, the post/block(13) deflection distance, before wheel snag is greater than the present art. The rail element(1) is positioned in a horizontal plane vertically above the ground-line to engage the "crush-zone" of the modern passenger vehicle and develop a "crease" into the vehicle body's crush-zone effectively denying the vehicle the ability to climb over or push under the rail element(1). To avoid environmentally unfriendly wood preserving methods, the rail and post elements are laminates fabricated from trans-polar sea wood. This wood is naturally preserved by compete saturation in icy arctic sea water ocean for at least one winter. The outer bark and living woody tissue has been completely abrased off by interaction with the arctic ice sheet and the timber is naturally air-dried. Once dried, the deposited sea salts, which has penetrated completely thru the timbers, acts as one of the present Invention's wood preservatives.

Only sea timbers harvested above 65° North Latitude are used. Sea wood from warmer waters can not be assured to be free of water-borne insect and boring sea life. Once cut to size, the individual laminates are allowed to air dry allowing the formation of a protective inert sea salt outer coating before the lamination process. Individual wood components to be laminated together can have grooves such as, but not limited to, a dovetail configuration so as to provide additional grip or shear-transfer properties once laminated. Configuration of such grooves allows the placement of insecticide, such as but not limited to garlic-extract. Said grooves can be used as key-ways for placement of naturally resistant wood species, such as cedar, within the interior of the laminated structural member.

References Cited:

Reference #1: "Design For Lateral Forces", James Ambrose & Dimitry Vergun, John Wiley & Sons, 1987, Reference #2: "Vector Mechanics For Engineers, Statics and Dynamics, Beer & Johnston, Mcgraw-Hill, 1962, Reference #3: "Weak Post vs Strong Post—What Gives? An Introduction To Guardrail Design", by Richard Powers, FHWA & William Fitzgerald, FHWA, February '99

Reference #4: "Timber Bridges—Design, Construction, Inspection and Maintenance" United States Department of Agriculture, Forest Service, August 1992, EM7700-8,

We claim:

1. A structural assembly designed primarily for lateral loads, suitable for highway guardrails, comprising at least one first supporting post member fixed at one end and attached to a second substantially horizontal structural rail member, wherein the rail member being the intended initial load carrying member has an aerodynamic cross-sectional shape which is asymmetric and tilted with respect to the horizontal plane to allow the passage of fluids perpendicular to the rail member without intentional creation of significant turbulence and providing a positive or negative vertical vector to such fluid flow perpendicular to the rail member, a geometry of the first supporting post member, above its fixed end, leans in an arch shape toward a direction of anticipated lateral loadings, and away from the vertical.

2. The structural assembly in accordance with claim 1, wherein the first supporting post member is of an aerodynamic cross-sectional shape for passage of fluids without intentional creation of significant turbulence.

3. The structural assembly in accordance with claim 1, wherein said aerodynamic cross-sectional shape is one of an oval and an ellipse shape.

4. The structural assembly in accordance with claim 1, wherein said structural assembly is a highway guardrail allowing for a less turbulent, more laminar flow of air across the highway perpendicular to said rail member to minimize precipitation of fluid-born solids onto nearby roadways.

5. The structural assembly in accordance with claim 2, wherein said structural assembly is a highway guardrail allowing for a less turbulent, more laminar flow of air across the highway perpendicular to said rail member to minimize precipitation of fluid-born solids onto nearby roadways.

6. The structural assembly in accordance with claim 3, wherein said structural assembly is a highway guardrail or bridge rail allowing for a less turbulent, more laminar flow of air across the highway perpendicular to said rail member to minimize precipitation of fluid-born solids onto nearby roadways.

7. The structural assembly in accordance with claim 1, whereby the structural members consist of at least one material selected from the group consisting of wood, plastic, rubber and metal including steel and aluminum.

8. The structural assembly in accordance with claim 1, whereby structural members consist of a structural composite of a plurality of components selected from the group consisting of wood, plastic, rubber and metal including steel and aluminum.

9. The structural assembly in accordance with claim 8, whereby said structural assembly acts, in part, as one of a highway guardrail and bridge rail and said structural rail member is a wood laminate having at least one metal element near, the surface of said rail member toward traffic, providing reinforcement for contact, with said rail member, by impacting vehicle elements.

10. The structural assembly in accordance with claim 8, whereby said structural assembly acts, in part, as one of a highway guardrail and bridge rail and said structural rail member is a wood laminate having at least one hardwood element near the surface of said rail member toward traffic, providing reinforcement for contact, with said rail member, by impacting vehicle elements.

11. The structural assembly in accordance with claim 8, whereby said structural assembly acts, in part, as one of a highway guardrail and bridge rail and said supporting post member is a wood laminate having at least one metal element near the surface of the post element toward traffic, providing reinforcement for contact, with said post member, by solids passing by the post member by virtue of snow-plowing.

12. The structural assembly in accordance with claim 1, wherein the geometry of the first supporting post member is such that the post arches over and then down before attachment to the second structural rail member, thereby requiring the deflection of the structural assembly, when laterally loaded, to rotate away in a manner such that the rail moves not only horizontally but also vertically.

13. The structural assembly in accordance with claim 12, wherein, an impacting force displaces and dislocates upwardly the rail element causing an impact vehicle to remain more horizontal and not dive down, during initial impact with the rail.

14. The structural assembly in accordance with claim 3, wherein the rail element is rotated, from the horizontal, to point downward in the general direction of the road surface, and the height of the rail element is such that the top of most impacting vehicles' bumpers, when the vehicle is not decelerating, by virtue of breaking or otherwise, will be below that part of the rail element closest to the line of traffic flow, allowing the aerodynamic shape of the rail element to encourage vehicles' bumpers to ride under the rail element thereby seating the rail element into the vehicles' crushable body sections, whereby an impacting vehicle is prevented from jumping the rail or diving under the rail because the aerodynamic rail element has been seated into the vehicles' crushable body sections.

15. The structural assembly in accordance with claim 7, wherein wood components are sourced from driftwood timbers secured from north of the 65th Latitude, saturated throughout its heartwood with seawater.

16. The structural assembly in accordance with claim 1, wherein the supporting post member's end which is distal from the fixed end is found off center or rotated away from the vertical axis of the structurally fixed end.

17. The structural assembly in accordance with claim 16, wherein a structurally unfixed post's end comprises ends of a plurality of branches.

18. The structural assembly in accordance with claim 17, wherein the structurally unfixed post's end comprises ends of a plurality of branches, where said branches have different cross-sectional areas along a length of individual branches, and branches arching in at least one of the vertical and both the vertical and horizontal planes relative to a foundation of the post.

19. The structural assembly in accordance with claim 17, wherein a structurally unfixed post's end comprises ends of a plurality of branches, where said branches have different cross-sectional shapes along a length of individual branches, and branches arching in at least one of the vertical and both the vertical and horizontal planes relative to a foundation of the post.

20. The structural assembly in accordance with claim 17, wherein a structurally unfixed post's end comprises ends of a plurality of branches, where said branches have different section modulus along a length of individual branches, and branches arching in at least one of the vertical plane and both the vertical and horizontal planes relative to a foundation of the post.

21. The structural assembly in accordance with claim 8, wherein an intended contact structural rail element comprising wood has an origination of the laminates provided for maximum lateral load carrying capacities by providing for one of a lower Coefficient of sliding friction and slicker surface, for an impacting vehicle.

22. The structural assembly in accordance with claim 1, whereby the first structural member's arch or bow shape allows for an energy-absorbing response to lateral loads.

23. The structural assembly in accordance with claim 1, whereby the first structural member's arch or bow crest above the rail element allows for a displacement under loading in a back-and-upward manner providing a vertically upward force on the second structural member.

24. The structural assembly in accordance with claim 1, whereby the first structural member is leaned toward a direction of the design-intended lateral load thereby allowing for a greater displacement before the first structural member would be vertical in relation to its foundation.

25. The structural assembly in accordance with claim 1, wherein said cross-sectional shape is one of an oval and ellipse shape.

26. The structural assembly in accordance with claim 8, wherein wood components are from driftwood timbers secured from forth of the 65th Latitude, completely saturated throughout its heartwood with seawater.

* * * * *